US007909660B2

(12) United States Patent
Tsunoda et al.

(10) Patent No.: US 7,909,660 B2
(45) Date of Patent: Mar. 22, 2011

(54) RIGHT ANGLE TYPE SPRING CONNECTOR

(75) Inventors: Tatsuo Tsunoda, Wembley (GB); Seppo Toivanen, Klaukkala (FI); Kenichi Sato, Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 12/669,683

(22) PCT Filed: Jul. 18, 2008

(86) PCT No.: PCT/JP2008/063455

§ 371 (c)(1),
(2), (4) Date: Jan. 19, 2010

(87) PCT Pub. No.: WO2009/011463

PCT Pub. Date: Jan. 22, 2009

(65) Prior Publication Data

US 2010/0197173 A1 Aug. 5, 2010

(30) Foreign Application Priority Data

Jul. 19, 2007 (JP) ..... P. 2007-188067

(51) Int. Cl.
*H01R 13/24* (2006.01)

(52) U.S. Cl. ..... 439/700

(58) Field of Classification Search ..... 439/700, 439/79, 80

See application file for complete search history.

(56) References Cited

U.S. PATENT DOCUMENTS

| | | | | |
|---|---|---|---|---|
| 6,340,320 | B1 | 1/2002 | Ogawa | |
| 6,814,626 | B2 * | 11/2004 | Wen-Yao | 439/700 |
| 6,923,690 | B1 * | 8/2005 | Wang | 439/824 |
| 7,201,613 | B2 * | 4/2007 | Sasaki | 439/700 |
| 7,435,109 | B1 * | 10/2008 | Sugiura | 439/83 |
| 7,476,132 | B2 * | 1/2009 | Xu | 439/700 |
| 7,662,000 | B2 * | 2/2010 | Hou et al. | 439/824 |
| 7,699,666 | B2 * | 4/2010 | Hohne et al. | 439/700 |
| 7,713,095 | B2 * | 5/2010 | Yodogawa | 439/700 |
| 7,789,719 | B1 * | 9/2010 | Yin et al. | 439/824 |
| 7,815,474 | B1 * | 10/2010 | Lin et al. | 439/700 |
| 2002/0160637 | A1 | 10/2002 | Ishizuka | |
| 2005/0064765 | A1 | 3/2005 | Simpson et al. | |
| 2005/0130507 | A1 * | 6/2005 | Arai et al. | 439/700 |
| 2009/0221189 | A1 * | 9/2009 | Xu | 439/700 |

FOREIGN PATENT DOCUMENTS

| | | |
|---|---|---|
| EP | 1 503 458 | 2/2005 |
| EP | 1 605 553 | 12/2005 |
| JP | 2003-17173 | 1/2003 |

* cited by examiner

*Primary Examiner* — T C Patel
*Assistant Examiner* — Harshad C Patel
(74) *Attorney, Agent, or Firm* — Morgan, Lewis & Bockius LLP

(57) ABSTRACT

To provide a right angle type spring connector in which a caulking work is not necessary, the number of components is small, and electric connection is reliably maintained.

The right angle type spring connector is configured as follows. A tube is formed with a narrowed portion so as to allow a distal end portion of a pin to project therefrom and prevent the pin from coming out. A connecting portion disposed on the tube and extending to a mounting surface and amounting surface abutting portion extending along the mounting surface are formed integrally with each other, and an engaging portion is provided on the mounting surface abutting portion. A holder is formed with a bottomed hole so as to allow the tube to be inserted. A locking portion is formed on the holder so as to engage the engaging portion in a state in which the tube is inserted into the bottomed hole.

8 Claims, 7 Drawing Sheets

RIGHT ANGLE TYPE SPRING CONNECTOR

TECHNICAL FIELD

The present invention relates to a right angle type spring connector having a small number of components and being easy to assemble.

BACKGROUND ART

Referring to FIG. 12, an example of a structure of a right angle type spring connector in the related art in which a pin is projected and retracted in substantially parallel to a mounting surface to be provided will be described in brief. FIG. 12 is a vertical cross-sectional view of the example of the structure of the right angle type spring connector in the related art. In FIG. 12, a tube 10 formed of a conductive material is firstly opened at the front end portion thereof and closed at the rear end portion thereof, and is provided with a flange-shaped portion 10*a* on an outer peripheral surface on the front side. A spring 12 and a pin 14 formed of a conductive material are inserted into the tube 10 in sequence from the opening side at the front end portion, and a narrowed portion is formed by caulking the opening at the front end portion in a state in which the spring 12 is compressed, and the distal end portion of the pin 14 is projected from the narrowed portion by a resiliently urging force of the spring 12 so as not to come out toward the front. The tube 10 is inserted and press-fitted into a hole 16*a* formed in a holder 16, which is formed of an insulating material, from the rear side. Then, a connecting member 18 formed of a conductive material which reaches a mounting surface 22 is provided integrally on the front surface of the hole 16*a* of the holder 16, a through hole 18*a* is formed so as to face the hole 16*a*, and an abutting member 20 bent so as to extend along the mounting surface 22 in an L-shape with respect to the connecting member 18. Then, when the tube 10 is inserted and press-fitted into the hole 16*a*, the connecting member 18 is clamped between the front surface of the holder 16 and the flange-shaped portion 10*a*, and the tube 10 comes into abutment with the connecting member 18, whereby being electrically connected. A right angle type spring connecter having a similar structure as the structure in the related art shown in FIG. 12 is shown in FIG. 13 in JP-A-2003-17173.

DISCLOSURE OF INVENTION

Technical Problem

In the related art shown in FIG. 12, the connecting member 18 is clamped between the front surface of the holder 16 and the flange-shaped portion 10*a* provided on the outer peripheral surface of the tube 10, and the tube 10 comes into abutment with and electrically connected with the connecting member 18. Therefore, when an impact or the like is applied to the tube 10 for any reason, the tube 10 may move in the direction coming out from the hole 16*a* of the holder 16, and hence electric connection between the connecting member 18 and the tube 10 may be cut off because clamping of the connecting member 18 cannot be maintained. In addition, the components such as the tube 10 in which the pin 14 and the spring 12 are integrated, the holder 16 and the connecting member 18 are required, and hence a large number of components are required. In addition, since the pin 14 and the spring 12 are integrated, a caulking work for forming the narrowed portion at the front end portion of the tube 10 is required, so that the number of manufacturing processes is disadvantageously increased correspondingly.

In view of such circumstances, it is an object of the present invention to provide a right angle type spring connector which does not require the caulking work, requires a small number of components, and ensures constant electric connection.

Technical Solution

In order to achieve the object described above, according to the present invention, there is provided a right angle type spring connector, comprising:

a pin, formed of a conductive material;

a tube, formed of a conductive material, and provided with a narrowed portion at a front end portion thereof so as to allow a distal end portion of the pin to project therefrom and prevent the pin from coming out toward the front, the tube provided with an opening at a rear end portion thereof so as to allow insertion of the pin, the tube integrally provided with a connecting portion that extends to a mounting surface, and a mounting surface abutting portion that extends rearward along the mounting surface and that is provided with an engaging portion; and a holder, formed of an insulating material, and provided with a bottomed hole at a front end surface thereof for allowing insertion of the tube from the rear end side thereof, the bottomed hole into which the tube in a state of having the pin and a spring inserted therein from the opening in sequence is inserted from the rear end side thereof so as to cause the spring to be compressed and resiliently urge the pin toward the front, the holder provided with a locking portion with which the engaging portion engages in a state in which the tube is inserted into the bottomed hole to prevent the tube from coming out from the bottomed hole by engagement between the engaging portion and the locking portion.

An inner hole of the tube in which the pin and the spring are inserted may be formed so as to be inclined in the vertical direction with respect to the mounting surface.

An inner hole of the tube in which the pin and the spring are inserted may be formed so as to be shifted in the lateral direction with respect to the fore-and-aft direction of the tube in a plane parallel to the mounting surface.

A plurality of the tubes may be formed integrally with the connecting portion.

Inner holes of the plurality of tubes in which the pins and the springs are inserted may be formed so as to be different from each other in height from the mounting surface.

Inner holes of the two tubes in which the pins and the springs are inserted may be formed to be inclined in the vertical direction with respect to the mounting surface and be narrower between the front end portions and wider between the rear end portions or wider between the front end portions and narrower between the rear end portions with respect to the fore-and-aft direction of the tubes.

Inner holes of the two tubes in which the pins and the springs are inserted may be formed to be shifted in the lateral direction in a plane extending in parallel with the mounting surface and be narrower between the front end portions and wider between the rear end portions or wider between the front end portions and narrower between the rear end portions with respect to the fore-and-aft direction of the tubes.

The mounting surface abutting portion may be configured to be electrically connected to a terminal provided on the mounting surface.

In order to achieve the object, according to the present invention, there is also provided a spring connector, comprising:

a conductive pin;

a conductive tube, one end of which is provided with a first opening having a first diameter larger than a diameter of the pin, the other end of which is provided with a second opening having a second diameter smaller than the diameter of the pin from which a distal end of the pin is projected, the tube monolithically provided with a connecting member to be connected to a terminal, the connecting member provided with an engaging portion; and a holder, adapted to hold the tube, and provided with a locking portion with which the engaging portion engages.

A central axis of the first opening and a central axis of the second opening may be offset with each other.

ADVANTAGEOUS EFFECTS

According to an aspect of the invention, since the connecting portion which extends to the mounting surface and the mounting surface abutting portion extending rearward along the mounting surface provided on the tube formed of the conductive material are formed integrally, electric connection between the mounting surface abutting portion electrically connected to the terminal provided on the mounting surface and the tube is not cut off. In addition, since the connecting portion and the mounting surface abutting portion are formed integrally with the tube, the number of components is small. Since the tube in a state of having the pin and the spring inserted in sequence is inserted into the bottomed hole of the holder, and the engaging portion provided on the mounting surface abutting portion which is formed integrally with the tube and the locking portion formed on the holder are engaged so as to hold the spring in the compressed state and prevent the tube from coming out from the bottomed hole, the caulking work which is required in the related art is not necessary.

According to an aspect of the invention, since the inner hole of the tube is formed so as to be inclined in the vertical direction with respect to the mounting surface, or shifted in the lateral direction with respect to the fore-and-aft direction of the tube in the plane parallel to the mounting surface, while the object abutting portion of the pin is pressed by the connected object and hence is retracted, the abutting position of the object abutting portion of the pin with respect to the connected object is shifted, and hence a cleaning effect is obtained. Therefore, reliable electric connection is achieved.

According to an aspect of the invention, since the plurality of tubes are formed integrally with one connecting portion, a plurality of electric paths are formed by bringing a plurality of the pins into abutment with the connected object, and hence positive and reliable electric conduction is achieved. It is also possible to bring the respective pins into abutment with a plurality of different connected objects to electrically connect the plurality of connected objects.

According to an aspect of the invention, since the inner holes of the plurality of tubes in which the pins and the springs are inserted are formed so as to be different in height from the mounting surface, a plurality of electric paths are formed at positions different in height by bringing the plurality of pins into abutment with positions of the connected object different in height, and hence the positive and reliable electric conduction is achieved. It is also possible to bring the respective pins into abutment with the plurality of connected objects different in height from the mounting surface to electrically connect the plurality of connected objects.

According to an aspect of the invention, since the inner holes of the two tubes are formed so as to be inclined in the vertical direction with respect to the mounting surface and be narrower between the front end portions and wider between the rear end portions or wider between the front end portions and narrower between the rear end portions with respect to the fore-and-aft direction of the tube, or formed so as to be shifted in the lateral direction in the plane extending in parallel to the mounting surface and be narrower between the front end portions and wider between the rear end portions or wider between the front end portions and narrower between the rear end portions with respect to the fore-and-aft direction of the tube, while the object abutting portion of the pin is pressed by the connected object and hence is retracted, the abutting position of the object abutting portion of the pin with respect to the connected object is shifted, and hence the cleaning effect is obtained. Also, by bringing the two pins into abutment with the connected object, the two electric paths are formed. Therefore, the reliable electric connection is achieved. With the configuration in which the inner holes are arranged with the front end portions narrower than between the rear end portions, the object abutting portions of the two pins may be abutted to the connected object having a small surface area.

According to an aspect of the invention, since the mounting surface abutting portion which is integral with the tube is electrically connected to the terminal provided on the mounting surface, the electric connection of the tube with respect to the terminal on the mounting surface is ensured.

BRIEF DESCRIPTION OF DRAWINGS

FIGS. 1A and 1B illustrate a first embodiment of a right angle type spring connector of the present invention, in which FIG. 1A is a vertical cross-sectional view and FIG. 1B is an appearance perspective view.

FIGS. 2A, 2B, 2C and 2D illustrate a member including a tube, a connecting portion and a mounting surface abutting portion integrated with each other in FIG. 1, in which FIG. 2A is a side view, FIG. 2B is a front view, FIG. 2C is a vertical cross-sectional view taken along the line A-A in FIG. 2B, and FIG. 2D is an appearance perspective view.

FIGS. 3A, 3B, 3C and 3D illustrate a holder in FIG. 1, in which FIG. 3A is a front view, FIG. 3B is a vertical cross-sectional view taken along the line B-B in FIG. 3A, FIG. 3C is an appearance perspective view, and FIG. 3D is a perspective view broken in vertical direction.

FIGS. 5A and 5B illustrate a tube used in a second modification of the first embodiment, in which FIG. 5A is a front view of the front end portion and FIG. 5B is a cross-sectional view taken along the line C-C in FIG. 5A.

FIGS. 6A and 6B illustrate a second embodiment of the right angle type spring connector according to the present invention, in which FIG. 6A is an appearance perspective view of a tube or the like used in the second embodiment and FIG. 6B is an appearance perspective view of the entire portion.

FIGS. 7A and 7B illustrate a tube used in a first modification of the second embodiment, in which FIG. 7A is an appearance perspective view of the tube and FIG. 7B is a front view of the front end portion.

FIGS. 8A and 8B illustrate a tube used in a second modification of the second embodiment, in which FIG. 8A is a front view of the front end portion and FIG. 8B is a cross-sectional view taken along the line D-D in FIG. 8A.

FIGS. 9A and 9B illustrate tubes used in a third modification of the second embodiment, in which FIG. 9A is a front view of the front end portion and FIG. 9B is a cross-sectional view taken along the line E-E in FIG. 9A.

FIGS. 10A, 10B and 10C illustrate tubes used in a fourth modification of the second embodiment, in which FIG. 10A is a front view of the front end portion, FIG. 10B is a cross-sectional view taken along the line F-F in FIG. 10A, and FIG. 10C is a cross-sectional view taken along the line G-G in FIG. 10A.

FIGS. 11A, 11B and 11C illustrate tubes used in a fifth modification of the second embodiment, in which FIG. 11A is a front view of the front end portion, FIG. 11B is a cross-sectional view taken along the line H-H in FIG. 11A, and FIG. 11C is a cross-sectional view taken along the line I-I in FIG. 11A.

BEST MODE FOR CARRYING OUT THE INVENTION

Figure 1A:
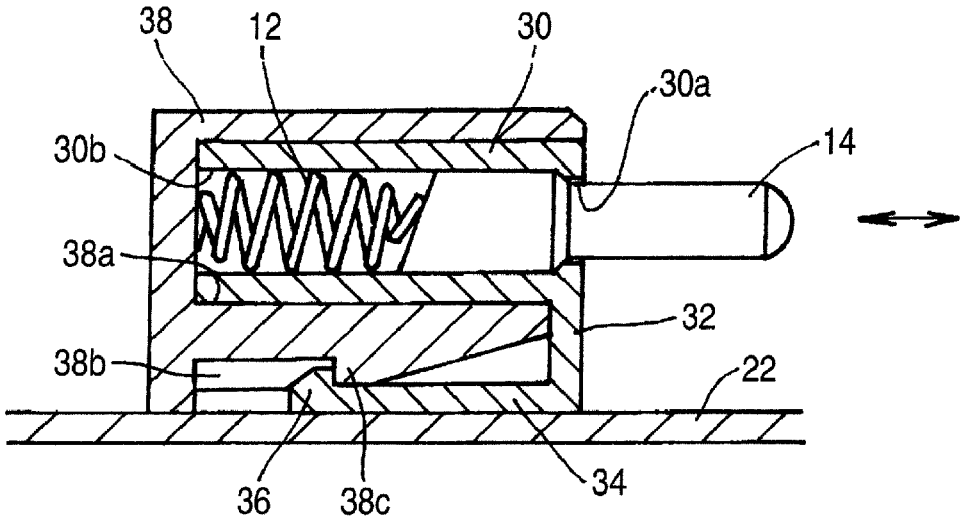
Figure 1B:
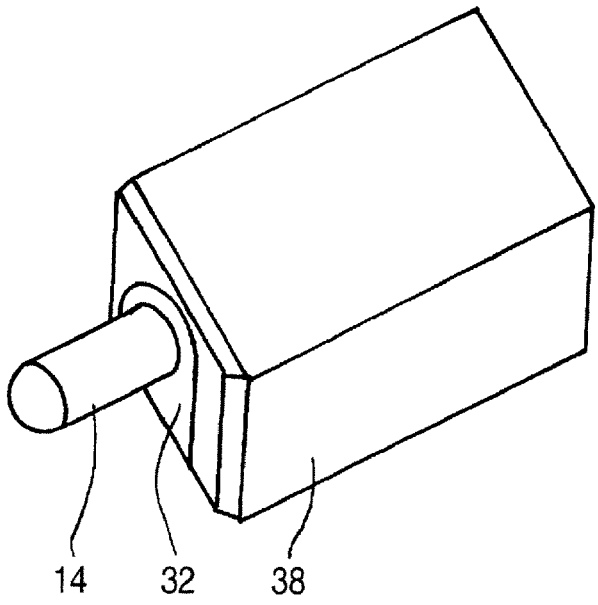
Figure 2A:
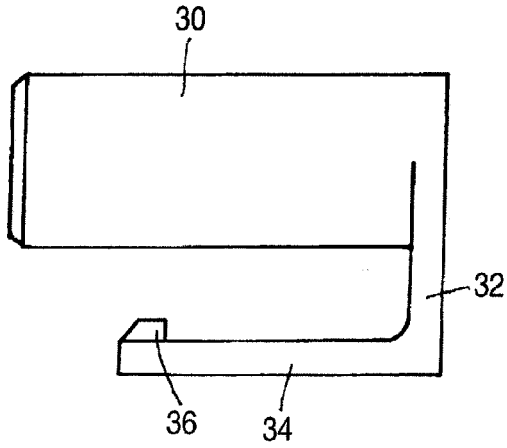
Figure 2B:
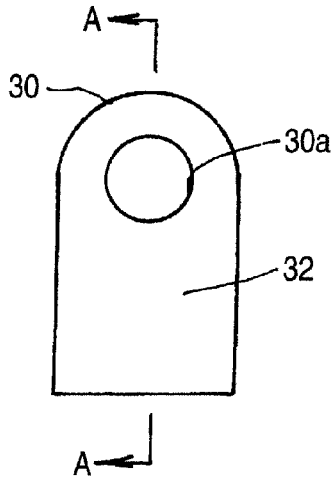
Figure 2C:
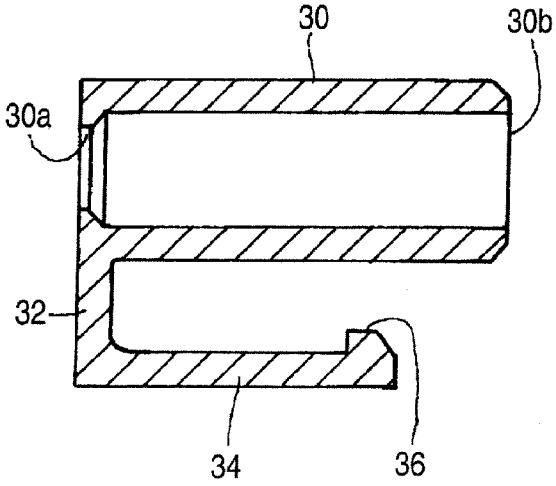
Figure 2D:
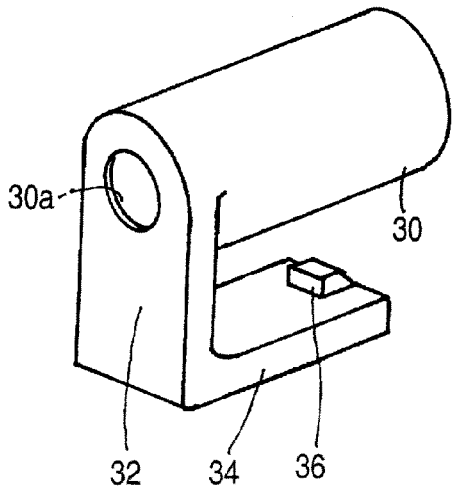
Figure 3A:
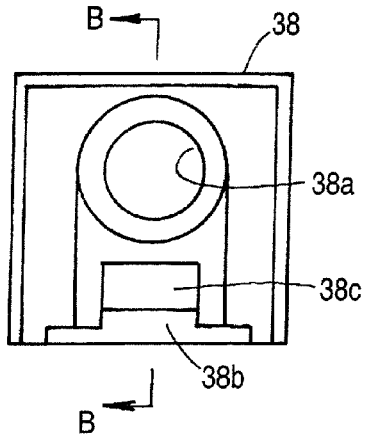
Figure 3B:
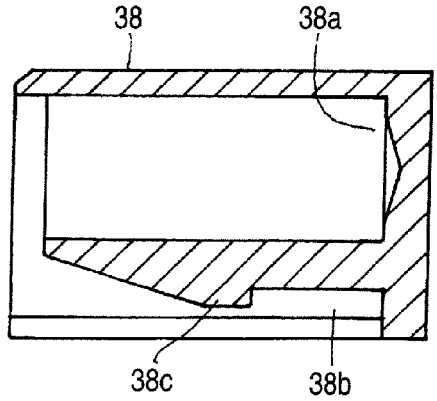
Figure 3C:
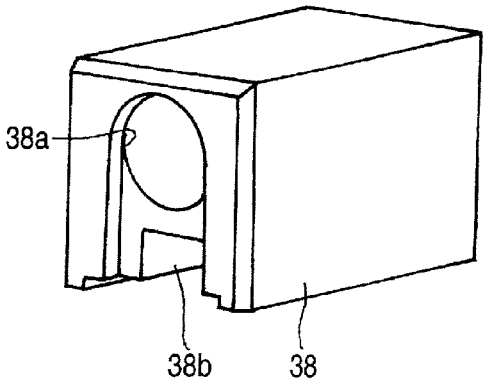
Figure 3D:
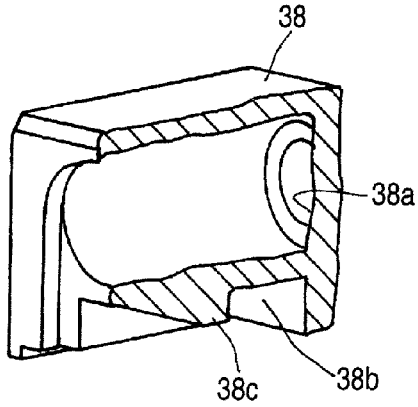

Referring now to FIG. 1A to FIG. 3D, a first embodiment of the present invention will be described.

In the first embodiment of the right angle type spring connector according to the present invention, a tube 30 formed of a conductive material is formed with a narrowed portion 30*a* at the front end portion of an inner hole thereof and an opening 30*b* at the rear end portion thereof. A connecting portion 32 is formed integrally from the outer peripheral surface of the front end portion to a mounting surface 22, and a mounting surface abutting portion 34 bent into an L-shape toward the rear so as to extend along the mounting surface 22 is integrally (monolithically) formed with the connecting portion 32, and an engaging portion 36 is formed at the free end of the mounting surface abutting portion 34. The tube 30, the connecting portion 32, the mounting surface abutting portion 34 and the engaging portion 36 are formed integrally with each other by, for example, a metal injection mold manufacturing method with a conductive material. A holder 38 formed of an insulating material is formed with a bottomed hole 38*a* from the front surface. A space 38*b* is provided for receiving the engaging portion 36 so that the tube 30 is inserted and press-fitted into the bottomed hole 38*a* from the rear side, and a locking portion 38*c* is provided in the space 38*b* so as to prevent the tube 30 from coming out toward the front by the engagement of the engaging portion 36 of the mounting surface abutting portion 34 in this inserted state. In a state in which a pin 14 and a spring 12 are inserted in sequence into the inner hole of the tube 30 from the opening 30*b* at the rear end portion, the tube 30 is inserted and press-fitted into the bottomed hole 38*a* of the holder 38 from the rear side. Then, the engaging portion 36 of the mounting surface abutting portion 34 engages the locking portion 38*c* of the holder 38, and the tube 30 is prevented from coming out toward the front from the bottomed hole 38*a* of the holder 38. The spring 12 here is compressed between the bottom portion of the bottomed hole 38*a* and the pin 14, and is set to resiliently urge the pin 14 toward the front. The tube 30 is formed with an inner hole for inserting the pin 14 and the spring 12 so as to extend in parallel with the mounting surface 22, and the outer peripheral surface of the tube 30 is formed to be coaxial with the inner hole. Then, the bottomed hole 38*a* of the holder 38 is formed so as to extend in parallel with the mounting surface 22. Therefore, the pin 14 is able to project and retract in the fore-and-aft direction of the tube 30 in parallel with the mounting surface 22. A diameter of the opening 30*b* at the rear end portion the tube 30 is larger than a diameter of the pin 14. A diameter of an opening of the narrowed portion 30*a* at the front end portion of the tube 30 is smaller than the diameter of the pin 14.

In the right angle type spring connector in the present invention configured as described above, since the connecting portion 32 which extends to the mounting surface 22 provided on the tube 30 formed of a conductive material and the mounting surface abutting portion 34 extending along the mounting surface 22 toward the rear are integrally provided, the mounting surface abutting portion 34 is fixed to a terminal (not shown) provided on the mounting surface 22 by soldering or the like and electrically connected thereto, even when an unexpected impact force or the like is applied to the tube 30, electric connection between the tube 30 and the terminal is not cut off, and the resistance value therebetween may be reduced to a value smaller than the device in the related art which has a contact surface in the way of the electric path. In addition, the connecting portion 32 and the mounting surface abutting portion 34 are integrally formed with the tube 30, and hence the number of components is small. Sine the tube 30 including the pin 14 and the spring 12 inserted in sequence is inserted into the bottomed hole 38*a* of the holder 38 and the engaging portion 36 provided on the mounting surface abutting portion 34 which is integral with the tube 30 is engaged with the locking portion 38*c* provided on the holder 38 so that the tube 30 is prevented from coming out toward the front from the bottomed hole 38*a* in a state in which the spring 12 is compressed, a caulking work which is required in the related art is not necessary. Therefore, an operating process is simple, and hence the right angle type spring connector is suitable for mass production.

Figure 4:
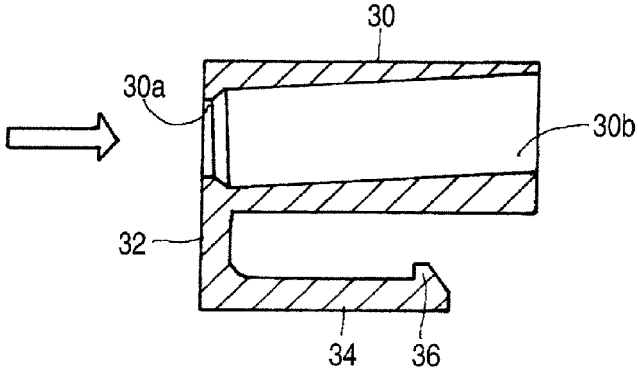
FIG. 4 is a vertical cross-sectional view of a tube used in a first modification of the first embodiment.

Referring now to FIG. 4, a first modification of the first embodiment will be described. As shown in FIG. 4, in the first modification, the inner hole of the tube 30 in which the pin 14 and the spring 12 are inserted is formed in such a manner that the front end portion is inclined downward with respect to the mounting surface 22. What is essential is that the inner hole is inclined with respect to the tube 30 in the vertical direction with respect to the mounting surface 22. While the object abutting portion of the pin 14 is pressed by a connected object and hence is retracted, the abutting position of the object abutting portion of the pin 14 with respect to the connected object is shifted, and hence a cleaning effect is obtained and the electric connection is ensured.

Figure 5A:
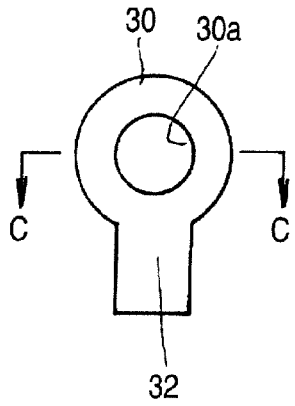
Figure 5B:
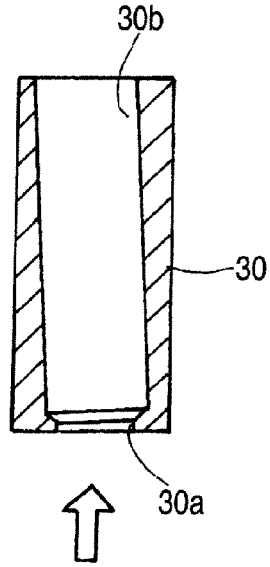

Referring now to FIGS. 5A and 5B, a second modification of the first embodiment will be described. As shown in FIG. 5, in the second modification, the inner hole in which the pin 14 and the spring 12 are inserted is formed so as to be shifted in the lateral direction with respect to the tube 30 in the fore-and-aft direction of the tube 30 in a plane parallel to the mounting surface 22. It is also possible to form the inner hole so as to be shifted with respect to the tube 30 in either lateral directions with respect to the fore-and-aft direction of the tube 30 in the plane parallel to the mounting surface 22. In the same manner as the first modification, while the object abutting portion of the pin 14 is pressed by the connected object and hence is retracted, the abutting position of the object abutting portion of the pin 14 with respect to the connected object is shifted, and hence the cleaning effect is obtained and the electric connection is ensured. The invention is not limited to the first modification and the second modification of the first embodiment, it is also possible to form the inner hole in which the pin 14 and the spring 12 are inserted so as to be inclined with respect to the tube 30 in either vertical directions and shifted with respect to the tube 30 in either lateral directions with respect to the fore-and-aft direction of the tube 30 in the plane parallel to the mounting surface 22.

In the first and second modifications of the first embodiment, a central axis of the opening of the narrowed portion 30*a* of the tube 30 and a central axis of the opening 30*b* of the tube 30 may be offset from each other.

Figure 6A:
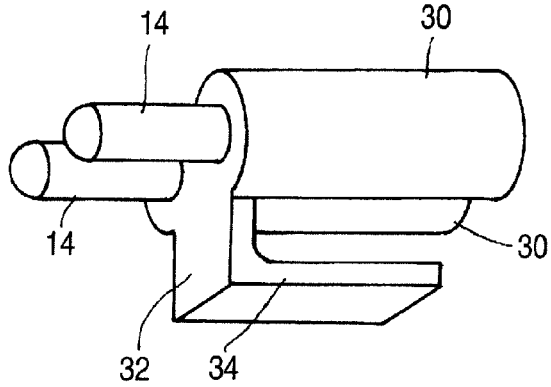
Figure 6B:
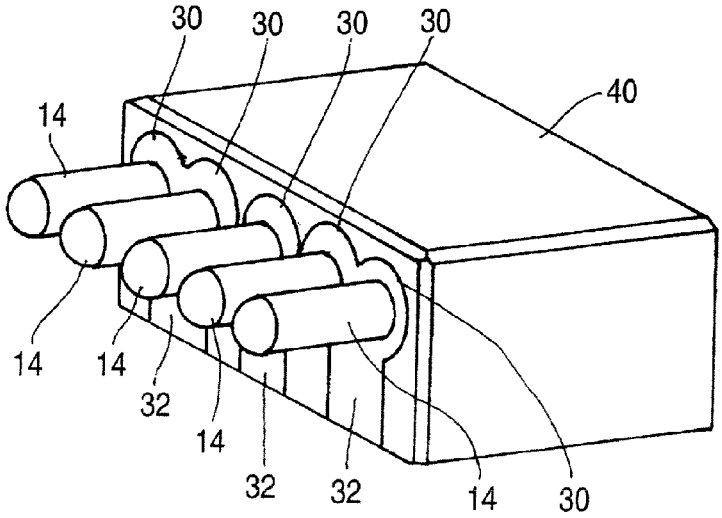

Referring now to FIGS. 6A and 6B, a second embodiment of the present invention will be described. In FIGS. 6A and 6B, the same or the equivalent members as those in FIG. 1A to FIG. 3D are designated by the same reference numerals and overlapped description will be omitted.

In the second embodiment, two tubes 30 are integrally provided in a parallel juxtaposed manner, and one each of the connecting portion 32, the mounting surface abutting portion 34 and the engaging portion 36 are provided for these two tubes 30 and formed integrally by a metal injection mold manufacturing method or the like. A holder 40 formed of an insulating material is provided with bottomed holes in which the integral part including the two tubes 30 can be inserted and press-fitted as needed. In the tubes 30, the pins 14 and the springs 12 are integrated respectively as in the first embodiment as a matter of course. Then, in FIG. 6B, the integral part including the two tubes 30 and a part including one tube 30 are inserted and press-fitted respectively into the holder 40. The two tubes 30 are provided in parallel at the same height from the mounting surface 22 and inner holes in which the pins 14 and the springs 12 are inserted are formed so as to extend in parallel to the mounting surface 22, and the outer peripheral surface of the tubes 30 are formed coaxially with the inner holes. The bottomed holes 38*a* of the holder 38 are also formed in parallel to the mounting surface 22. Therefore, the pins 14 are able to project and retract in the fore-and-aft direction of the tubes 30 in parallel to the mounting surface 22.

In the part in which the two tubes 30 are integrated, in order to form a single electric path, the two pins 14 come into abutment with a single connected object respectively to form a parallel circuit. Therefore, even when one of the pins 14 cannot establish the electric contact from any reason such as attachment of dust or the like, conduction in the electric path is achieved as long as the other pin 14 can establish a normal electric contact, so that the reliable electric path is achieved. In the second embodiment, the respective pins 14 may be brought into contact with two different connected objects so that the two connected objects are electrically connected to each other.

Figure 7A:
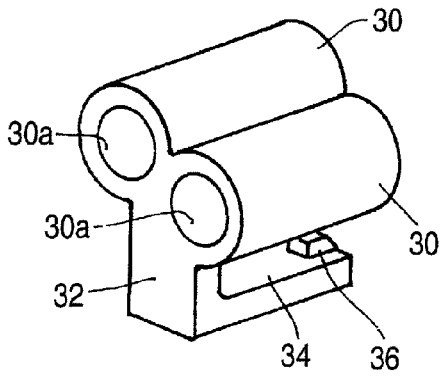
Figure 7B:
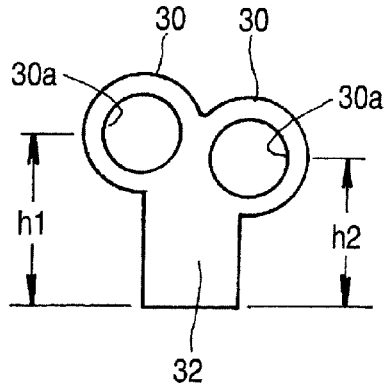

Referring now to FIGS. 7A and 7B, a first modification of the second embodiment will be described. As shown in FIGS. 7A and 7B, in the first modification, the two tubes 30 are formed with inner holes in which the pins 14 and the springs 12 are inserted are formed at different heights h1 and h2 from the mounting surface 22. By bringing the two pins 14 into abutment with positions at different height of the connected object, two electric paths are formed at the different heights, and hence further positive and reliable electric conduction is achieved. It is also possible to bring the respective pins 14 into abutment with the two connected objects at the different heights from the mounting surface 22 to electrically connect the two connected objects.

Figure 8A:
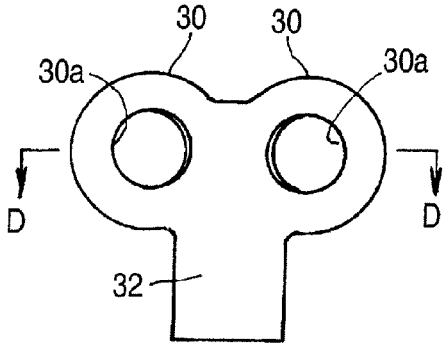
Figure 8B:
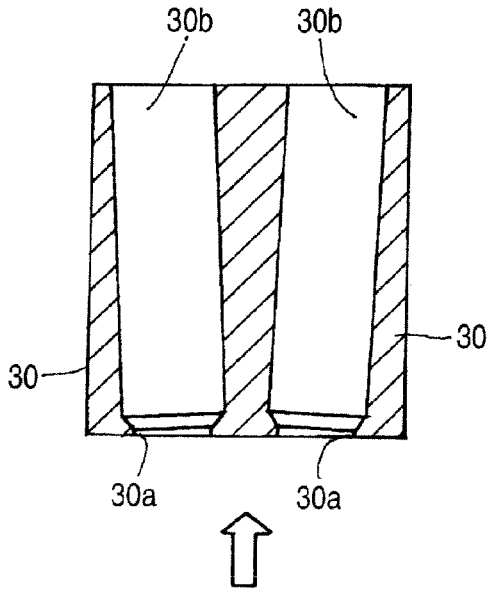

Referring now to FIGS. 8A and 8B, a second modification of the second embodiment will be described. As shown in FIGS. 8A and 8B, in the second modification, the two tubes 30 are formed with inner holes in which the pins 14 and the springs 12 are inserted so as to be shifted in the lateral direction with respect to the fore-and-aft direction of the tubes 30 in a plane at the same height from and parallel to the mounting surface 22 to be narrower between the front end portions and wider between the rear end portions. While the object abutting portions of the pins 14 are pressed by the connected object and hence are retracted, the abutting positions of the object abutting portions of the pins 14 with respect to the connected object are shifted, and hence the cleaning effect is obtained, and by bringing the two pins 14 into abutment with the connected object, two electric paths are formed so that the reliable electric connection is achieved. Furthermore, the inner holes are arranged so as to be narrower at the front end portions than the rear end portions, the object abutting portions of the two pins 14 may be brought into abutment with the connected object having a small surface area.

Figure 9A:
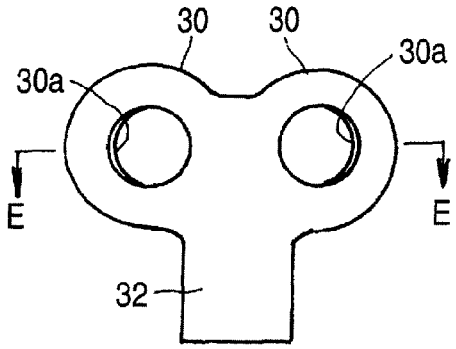
Figure 9B:
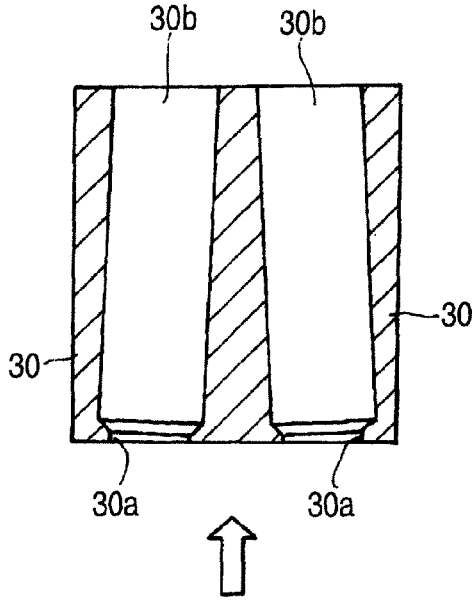

In addition, referring to FIGS. 9A and 9B, a third modification of the second embodiment will be described. As shown in FIGS. 9A and 9B, in the third modification, the two tubes 30 are formed with inner holes in which the pins 14 and the springs 12 are inserted so as to be shifted in the lateral direction with respect to the fore-and-aft direction of the tubes 30 in a plane at the same height from and parallel to the mounting surface 22 to be wider between the front end portions and narrower between the rear end portions. In the same manner as the second modification, while the object abutting portions of the pins 14 are pressed by the connected object and hence are retracted, the abutting positions of the object abutting portions of the pins 14 with respect to the connected object are shifted, and hence the cleaning effect is obtained, and by bringing the two pins 14 into abutment with the connected object, two electric paths are formed so that the reliable electric connection is achieved.

Figure 10A:
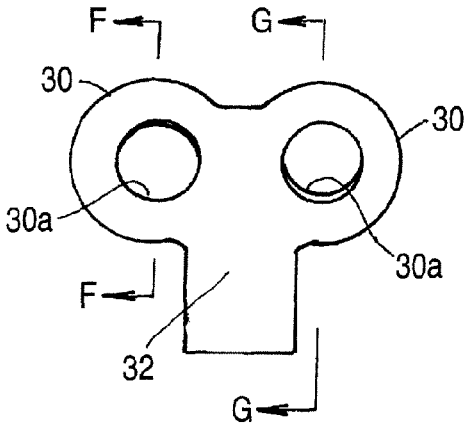
Figure 10B:
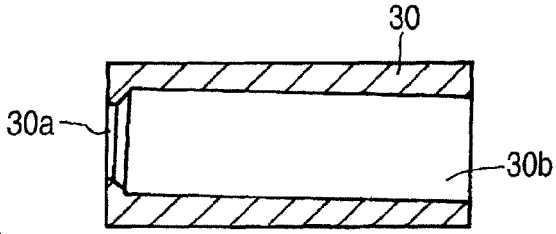
Figure 10C:
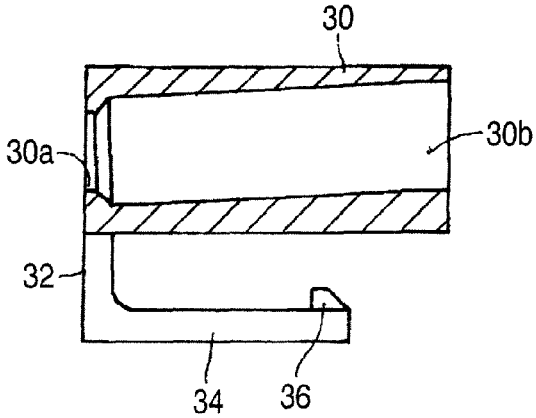

Referring to FIGS. 10A, 10B and 10C, a fourth modification of the second embodiment will be described. As shown in FIG. 10A to 10C, in the fourth modification, the two tubes 30 are formed with inner holes in which the pins 14 and the springs 12 are inserted so as to be inclined in the vertical direction with respect to the mounting surface 22 and be wider between the front end portions and narrower between the rear end portions in side view. In the same manner as the second and third modifications, while the object abutting portions of the pins 14 are pressed by the connected object and hence are retracted, the abutting positions of the object abutting portions of the pins 14 with respect to the connected object are shifted, and hence the cleaning effect is obtained, and by brining the two pins 14 into abutment with the connected object, two electric paths are formed so that the reliable electric connection is achieved.

Figure 11A:
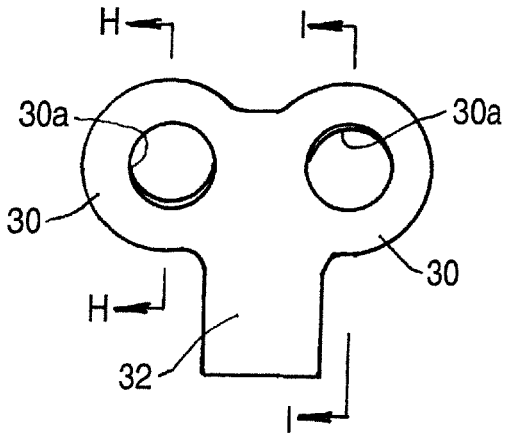
Figure 11B:
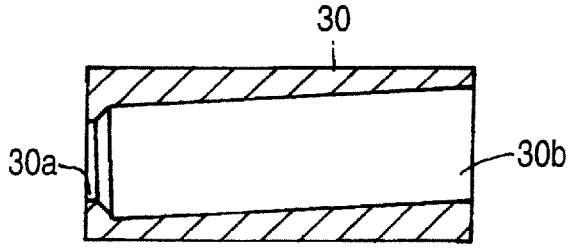
Figure 11C:
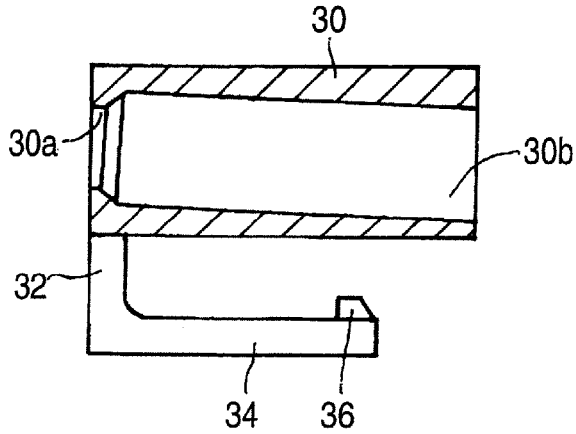
Figure 12:
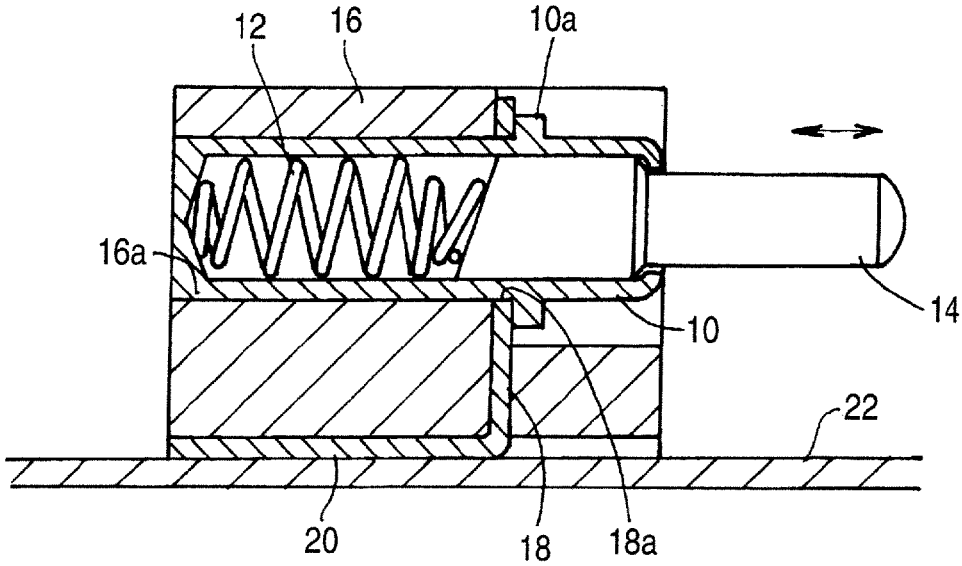
FIG. 12 is a vertical cross-sectional view of an example of a structure of the right angle type spring connector in the related art.

Referring now to FIGS. 11A, 11B and 11C, a fifth modification of the second embodiment will be described. As shown in FIGS. 11A to 11C, in the fifth modification, the two tubes 30 are formed with inner holes in which the pins 14 and the springs 12 are inserted so as to be inclined in the vertical direction with respect to the mounting surface 22 and be narrower between the front end portions and wider between the rear end portions in side view. In the same manner as the second and fourth modifications, while the object abutting portions of the pins 14 are pressed by the connected object and hence are retracted, the abutting positions of the object abutting portions of the pins 14 with respect to the connected object are shifted, and hence the cleaning effect is obtained, and by brining the two pins 14 into abutment with the connected object, two electric paths are formed so that the reliable electric connection is obtained. The invention is not limited to the second to fifth modifications of the second embodiment, it is also possible to form the inner holes in which the pins 14 and the springs 12 are inserted so as to be inclined with respect to the tubes 30 in either vertical directions and shifted in either lateral directions with respect to the fore-and-aft direction of the tubes 30. The vertical inclination and the lateral shifting of the inner holes of the tubes 30 may be in the same direction.

Either in the first embodiment and in the second embodiment, the shapes of the engaging portion 36 and the locking portion 38*c* are not limited thereto and may be any shapes as long as the tube 30 is prevented from coming out toward the front from the holders 38, 40 in the inserted state. In the second embodiment, the part including the two tubes 30 integrated with each other is exemplified, a part including three or more tubes 30 integrated with each other depending on the reliability of the electric path or the current-carrying capacity may also be employed. Furthermore, the bottom portion of the bottomed hole 38*a* provided in the holder 38 is of any form as long as the spring 12 is compressed without projecting rearward, and a small through hole which does not allow the spring 12 to project therefrom is also applicable.

INDUSTRIAL APPLICABILITY

The present invention is applicable to a right angle type spring connector.

The invention claimed is:

1. A right angle type spring connector, comprising:

a pin, formed of a conductive material;

a tube, formed of a conductive material, and provided with a narrowed portion at a front end portion thereof so as to allow a distal end portion of the pin to project therefrom and prevent the pin from coming out toward the front, the tube provided with an opening at a rear end portion thereof so as to allow insertion of the pin, the tube integrally provided with a connecting portion that extends to a mounting surface, and a mounting surface abutting portion that extends rearward along the mounting surface and that is provided with an engaging portion; and a holder, formed of an insulating material, and provided with a bottomed hole at a front end surface thereof for allowing insertion of the tube from the rear end side thereof, the bottomed hole into which the tube in a state of having the pin and a spring inserted therein from the opening in sequence is inserted from the rear end side thereof so as to cause the spring to be compressed and resiliently urge the pin toward the front, the holder provided with a locking portion with which the engaging portion engages in a state in which the tube is inserted into the bottomed hole to prevent the tube from coming out from the bottomed hole by engagement between the engaging portion and the locking portion.

2. The right angle type spring connector according to claim 1, wherein an inner hole of the tube in which the pin and the spring are inserted is formed so as to be inclined in the vertical direction with respect to the mounting surface.

3. The right angle type spring connector according to claim 1, wherein an inner hole of the tube in which the pin and the spring are inserted is formed so as to be shifted in the lateral direction with respect to the fore-and-aft direction of the tube in a plane parallel to the mounting surface.

4. The right angle type spring connector according to claim 1, wherein a plurality of the tubes are formed integrally with the connecting portion.

5. The right angle type spring connector according to claim 4, wherein inner holes of the plurality of tubes in which the pins and the springs are inserted are formed so as to be different from each other in height from the mounting surface.

6. The right angle type spring connector according to claim 4, wherein inner holes of the two tubes in which the pins and the springs are inserted are formed to be inclined in the vertical direction with respect to the mounting surface and be narrower between the front end portions and wider between the rear end portions or wider between the front end portions and narrower between the rear end portions with respect to the fore-and-aft direction of the tubes.

7. The right angle type spring connector according to claim 4, wherein inner holes of the two tubes in which the pins and the springs are inserted are formed to be shifted in the lateral direction in a plane extending in parallel with the mounting surface and be narrower between the front end portions and wider between the rear end portions or wider between the front end portions and narrower between the rear end portions with respect to the fore-and-aft direction of the tubes.

8. The right angle type spring connector according to any one of claims 1 to 7, wherein the mounting surface abutting portion is configured to be electrically connected to a terminal provided on the mounting surface.

* * * * *